US010873991B2

(12) United States Patent
Prasher et al.

(10) Patent No.: US 10,873,991 B2
(45) Date of Patent: Dec. 22, 2020

(54) PHOTONIC NEAR INFRARED HEATER

(71) Applicants: Ravi Shankar Prasher, Danville, CA (US); Hao Wang, Richmond, CA (US); Justin Palmer Freedman, Berkeley, CA (US)

(72) Inventors: Ravi Shankar Prasher, Danville, CA (US); Hao Wang, Richmond, CA (US); Justin Palmer Freedman, Berkeley, CA (US)

(73) Assignee: The Regents of the University of California, Oakland, CA (US)

( * ) Notice: Subject to any disclaimer, the term of this patent is extended or adjusted under 35 U.S.C. 154(b) by 330 days.

(21) Appl. No.: 15/879,885

(22) Filed: Jan. 25, 2018

(65) Prior Publication Data

US 2018/0220491 A1 Aug. 2, 2018

Related U.S. Application Data

(60) Provisional application No. 62/451,508, filed on Jan. 27, 2017.

(51) Int. Cl.
*H05B 3/00* (2006.01)

(52) U.S. Cl.
CPC ..... *H05B 3/009* (2013.01)

(58) Field of Classification Search
CPC .. G02B 5/0825; G02B 5/0833; G02B 5/0858; G02B 5/281; G02B 5/283; G02B 5/285; G02B 5/282; H05B 3/009
USPC ..... 359/359, 589, 586, 588; 219/553
See application file for complete search history.

(56) References Cited

U.S. PATENT DOCUMENTS 6,768,256 B1 * 7/2004 Fleming ..... B82Y 20/00 313/271
6,927,900 B2 * 8/2005 Liu ..... B32B 17/10 359/359
7,123,416 B1 * 10/2006 Erdogan ..... G02B 5/288 359/589
7,190,524 B2 * 3/2007 Grawert ..... G02B 5/0833 359/584
8,593,728 B2 * 11/2013 Banerjee ..... G02B 5/281 359/359

(Continued)

OTHER PUBLICATIONS

Wang, H., et al., "A Nano-Photonic Filter for Near Infrared Radiative Heater," Applied Thermal Engineering vol. 153, May 5, 2019, pp. 221-224.

(Continued)

*Primary Examiner* — Charles Cheyney

(57) ABSTRACT

A multilayer photonic stack comprising a lower plurality of alternating layers comprising at least A and B and an upper plurality of alternating layers comprising at least C and D, layer A comprises at least one of Al, Au, W, Ag, Ni, Ti, Pt, and Cr, layer B comprises at least one of $Al_2O_3$, AlN, MgO, $SiO_2$, $TiO_2$, $Si_3N_4$, $MgF_2$, $Ta_2O_5$, SiC, Si, Ge, and Indium Tin Oxide (ITO), and layers C and D comprise at least one of $Al_2O_3$, AlN, MgO, $SiO_2$, $TiO_2$, $Si_3N_4$, $MgF_2$, $Ta_2O_5$, SiC, Si, Ge, and Indium Tin Oxide (ITO).

5 Claims, 5 Drawing Sheets

(56) References Cited

U.S. PATENT DOCUMENTS

| | | | | |
|---|---|---|---|---|
| 2004/0047055 | A1* | 3/2004 | Mizrahi | G02B 5/0833 359/883 |
| 2011/0310472 | A1* | 12/2011 | Hirai | C23C 14/081 359/359 |
| 2015/0103398 | A1* | 4/2015 | Banerjee | G02B 5/281 359/360 |

OTHER PUBLICATIONS

U.S. Department of Energy, Advanced Research Projects Agency-Energy (ARPA-E) program, "DELTA Program Overview," May 21, 2015.

* cited by examiner

PHOTONIC NEAR INFRARED HEATER

CROSS REFERENCE TO RELATED APPLICATIONS

This application claims priority to US Provisional Application Ser. No. 62/451,508 filed Jan. 27, 2017, which application is incorporated herein by reference as if fully set forth in their entirety.

STATEMENT OF GOVERNMENTAL SUPPORT

The invention described and claimed herein was made in part utilizing funds supplied by the U.S. Department of Energy under Contract No. DE-AC02-05CH11231 between the U.S. Department of Energy and the Regents of the University of California for the management and operation of the Lawrence Berkeley National Laboratory. The government has certain rights in this invention.

BACKGROUND OF THE INVENTION

Field of the Invention

The present invention relates to the field of Radiative Heaters.

Related Art

Radiative heaters such as infrared (IR) heaters are readily available in the market, however they suffer from two fundamental problems: (1) strong visible emission. The visible appearance of IR heaters greatly impacts the aesthetics of building interiors. As a result, these heaters have only been popular in outdoor and warehouse applications, where convective heating is impractical. (2) IR heater coils for space heating are typically made of Nichrome, which operate at ~800 degree celsius. The emission peak of these. IR heaters is at ~3 um, which coincides with strong liquid water absorption. Due to water absorption overhead, infrared heaters tend to overheat the exposed areas of the human body (face and head) and underheat the clothed areas (feet and legs), creating discomfort due to the thermal asymmetry as well as skin dehydration.

Industrial process heating: Process heating, such as curing, is very important in industrial coil coating processes. Traditional convective oven curing processes heat the entire sample and its substrate, followed by a cooling process where the substrate temperature decreases over a long period of time. The curing and cooling process can take hours, which is both energy and time consuming. Radiative curing has the ability to raise the temperature of the coating only, meanwhile maintain a low temperature throughout the sample's substrate. This is a more efficient process because the curing and cooling time is significantly reduced and less thermal energy is required. However, the generally used UV curing technology suffers from a high system cost and is subject to the photochemical reaction, and the IR radiation curing technology is not very effective due to its very small penetration depth into the material. In addition, recent research has also shown that if the radiative energy is absorbed in the top few microns of the coating, film formation may occur before full removal of solvents, which affects the film quality. This makes long wavelength IR radiation (>3 um) undesirable in coating curing processes.

Food processing: IR radiation is currently used in food processing and drying. However, long wavelength IR radiation (>3 um) does not penetrate through the first few microns of the food leading to slower and non-uniform dehydration at the surface.

Previous work has demonstrated structures with spectral selectivity over a wide range of wavelengths. There are other works which designed an optical structure that is transmissive in the visible range of light (0.4-0.7 μm) and highly reflective in the near infrared and infrared range. These inventions demonstrated photonic crystal designs that transmit desired visible light, which increase the efficiency of a visible light source. Other works have designed devices for selective infrared transmissivity over a range of wavelengths, while reflecting visible light.

However, no other work has aimed specifically at spectral selectivity in the near infrared range between 0.7 and 3 μm for the applications mentioned above. In addition, the prior work regarding spectrally selective infrared filters and emitters employed materials that lack thermal, chemical and mechanical stability at high operating temperatures. The devices disclosed herein are the first spectrally selective near infrared transmitters/emitters that operate at, high temperatures associated with the previous mentioned industrial applications.

BRIEF DESCRIPTION OF THE DRAWINGS

The foregoing aspects and others will be readily appreciated by the skilled artisan from the following description of illustrative embodiments when read in conjunction with the accompanying drawings.

DETAILED DESCRIPTION

In the discussions that follow, various process steps may or may not be described using certain types of manufacturing equipment, along with certain process parameters. It is to be appreciated that other types of equipment can be used, with different process parameters employed, and that some of the steps may be performed in other manufacturing equipment without departing from the scope of this invention. Furthermore, different process parameters or manufacturing equipment could be substituted for those described herein without departing from the scope of the invention.

These and other details and advantages of the present invention will become more fully apparent from the following description taken in conjunction with the accompanying drawings.

The invention relates to a photonic device that predominately radiates in the near infrared (NIR) range of electromagnetic wavelengths (0.7~3 um). More specifically, the invention relates to the multilayered stack, which can either be used as stand alone photonic device or can be coated onto different host structures or substrates to turn them into the photonic devices. The said multilayered stack in the photonic device can have either of the two designs as described herein.

Figure 1:
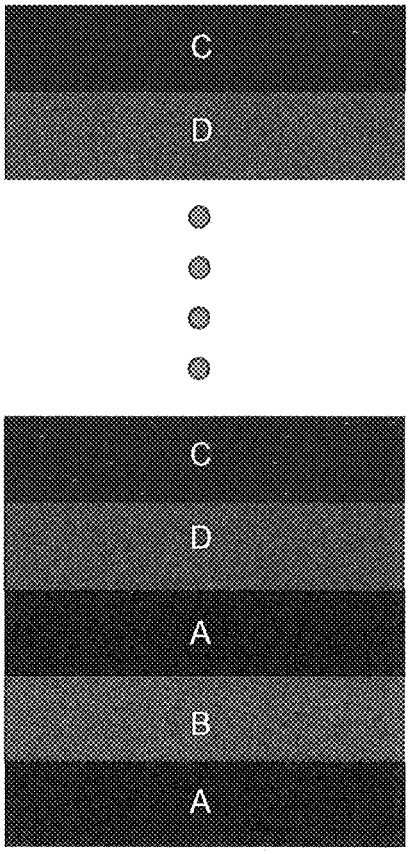
FIG. 1 illustrates a generalized schematic for a design 1.

The first design of the photonic device is comprised of a multilayer stack (with schematic shown as FIG. 1), with the bottom section of the multilayer stack comprised of layers A-B-A (from bottom to top) and the top section has alternating layers comprised of materials C and D, note that there are no strict constraints on the number of periods. The materials for layer A can be but are not limited to Al, Au, W, Ag, Ni, Ti, Pt, or Cr. The materials for layer B can be but are not limited to $Al_2O_3$, AlN, MgO, $SiO_2$, $TiO_2$, $Si_3N_4$, $MgF_2$, $Ta_2O_5$, SiC, Si, Ge, and Indium Tin Oxide (ITO). Note that the photonic device will still work if the bottom section of the multilayered stack has layers A-B (from bottom to top). The thickness of layers A and B can vary from 5 nm to 1 μm. The thickness of layers C and D can vary from 5 nm to 1 um and the materials for C and D can be but are not limited to $Al_2O_3$, AlN, MgO, $SiO_2$, $TiO_2$, $Si_3N_4$, $MgF_2$, $Ta_2O_5$, SiC, Si, Ge, and Indium Tin Oxide (ITO).

Figure 2:
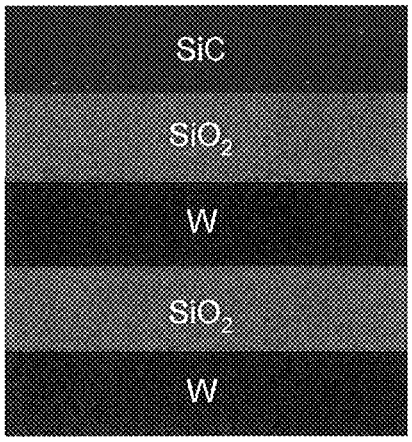
FIG. 2 illustrates a specific example of design 1, a photo for a fabricated sample, and a measured spectral emissivity.
Figure 2:
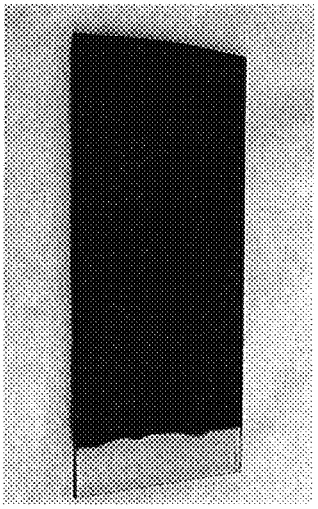
Figure 2:
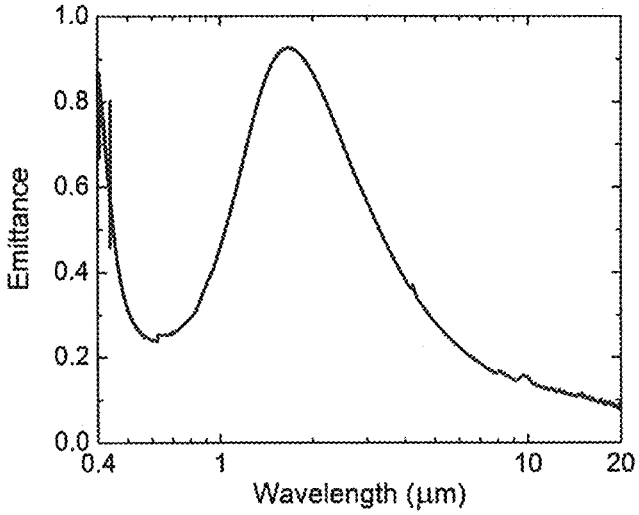

The above-described design of the photonic device has a high emissivity in the NIR range, peaking between wavelength of 0.7 um and 3 um. The emissivity of the photonic device in the visible range of electromagnetic radiation (wavelengths between 0.4~0.7 um) and IR (wavelengths >3 um) is close to zero. A specific example of this design is shown in FIG. 2, with the schematic shown as FIG. 2 and a photo of the fabricated sample (fabricated with magnetron sputtering process) as FIG. 2. The measured emissivity (indirectly measured based on Kirchhoff's law: Emissivity=Absorptivity=1-Reflectivity) with an FTIR spectrometer is presented in FIG. 2, showing its selective emittance in the near infrared range from 0.7~3 um.

Figure 3:
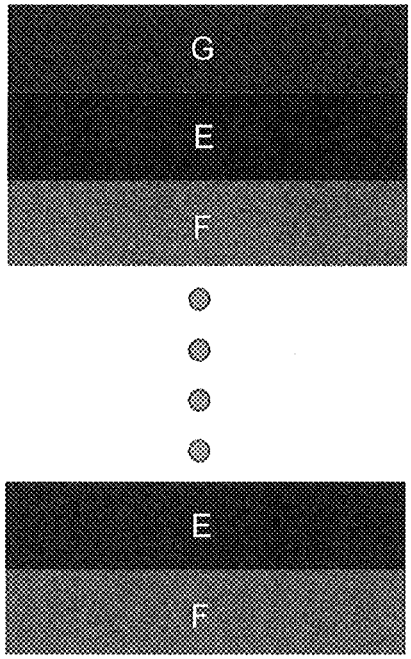
FIG. 3 illustrates a generalized schematic for a design 2.
Figure 4:
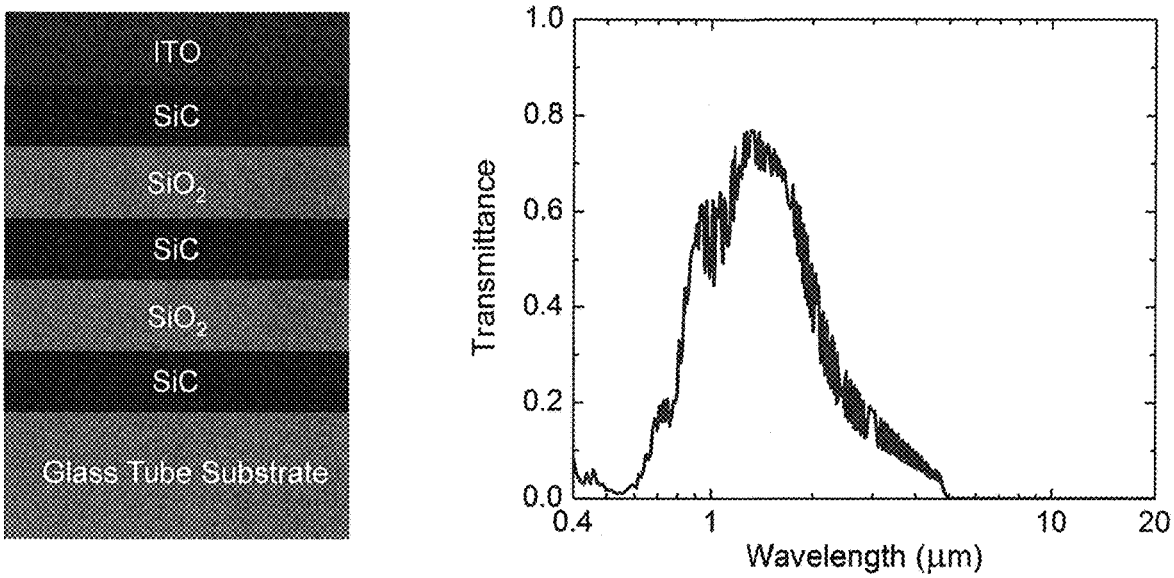
FIG. 4 illustrates a specific example of design 2, and a measured spectral emissivity.

The second design for the photonic device is comprised of multilayer stacks (schematic shown as FIG. 3) and is only transparent to NIR radiation. Therefore, this structure can be deposited on the tube of any radiative lamp and form a radiative heater that mainly generates NIR electromagnetic radiation. The transmissivity of this structure peaks between wavelengths of 700 nm and 3 um and is close to zero outside that wavelength range. The bottom section of this multilayer stack is comprised of several periods of alternating layers of E and F and their respective thicknesses range from 5 nm to 1 um. The materials for layer E and F can be but are not limited to $Al_2O_3$, AlN, MgO, $SiO_2$, $TiO_2$, $Si_3N_4$, $MgF_2$, $Ta_2O_5$, SiC, Si, Ge, and Indium Tin Oxide (ITO). The top layer of this structure is formed by material G with a thickness varying between 10 nm and 10 um. Materials for G can be but are not limited to $Al_2O_3$, AlN, MgO, $SiO_2$, $TiO_2$, $Si_3N_4$, $MgF_2$, $Ta_2O_5$, SiC, Si, Ge, and Indium Tin Oxide (ITO). FIG. 4 shows a specific example of this design 2.

TABLE 1

Measured emissivity vs wavelength for design 1 shown in FIG. 2

| | | | | | |
|---|---|---|---|---|---|
| Wavelength (nm) | 500 | 550 | 600 | 650 | 700 |
| Emissivity | 0.31 | 0.26 | 0.24 | 0.25 | 0.26 |
| Wavelength (mm) | 0.8 | 1 | 1.2 | 1.4 | 1.6 |
| Emissivity | 0.29 | 0.46 | 0.67 | 0.85 | 0.92 |
| Wavelength (mm) | 1.8 | 2 | 2.5 | 3 | 5 |
| Emissivity | 0.91 | 0.87 | 0.70 | 0.57 | 0.28 |
| Wavelength (mm) | 7 | 10 | 13 | 15 | 20 |
| Emissivity | 0.19 | 0.15 | 0.12 | 0.11 | 0.08 |

FIG. 4 presents the theoretical transmittance for the designed structure shown in FIG. 4, from which the selective NIR transmittance peaks from 0.7~3 um can be identified.

TABLE 2

Theoretical transmittance vs wavelength for design 2 shown in FIG. 4

| | | | | | |
|---|---|---|---|---|---|
| Wavelength (nm) | 500 | 550 | 600 | 650 | 700 |
| Transmittance | 0.33 | 0.06 | 0.06 | 0.07 | 0.10 |
| Wavelength (mm) | 0.8 | 1 | 1.2 | 1.4 | 1.6 |
| Transmittance | 0.10 | 0.64 | 0.76 | 0.76 | 0.68 |
| Wavelength (mm) | 1.8 | 2 | 2.5 | 3 | 5 |
| Transmittance | 0.62 | 0.42 | 0.22 | 0.16 | 0 |
| Wavelength (mm) | 7 | 10 | 13 | 15 | 20 |
| Transmittance | 0 | 0 | 0 | 0 | 0 |

The described, invention is novel as a near infrared heater for numerous applications including building heating, industrial process heating, and food processing. This is because the NIR heater described in this disclosure makes the listed heating processes more efficient and increases human comfort for buildings application, as well as increases, manufacturing productivity and energy efficiency in manufacturing applications.

Figure 5:
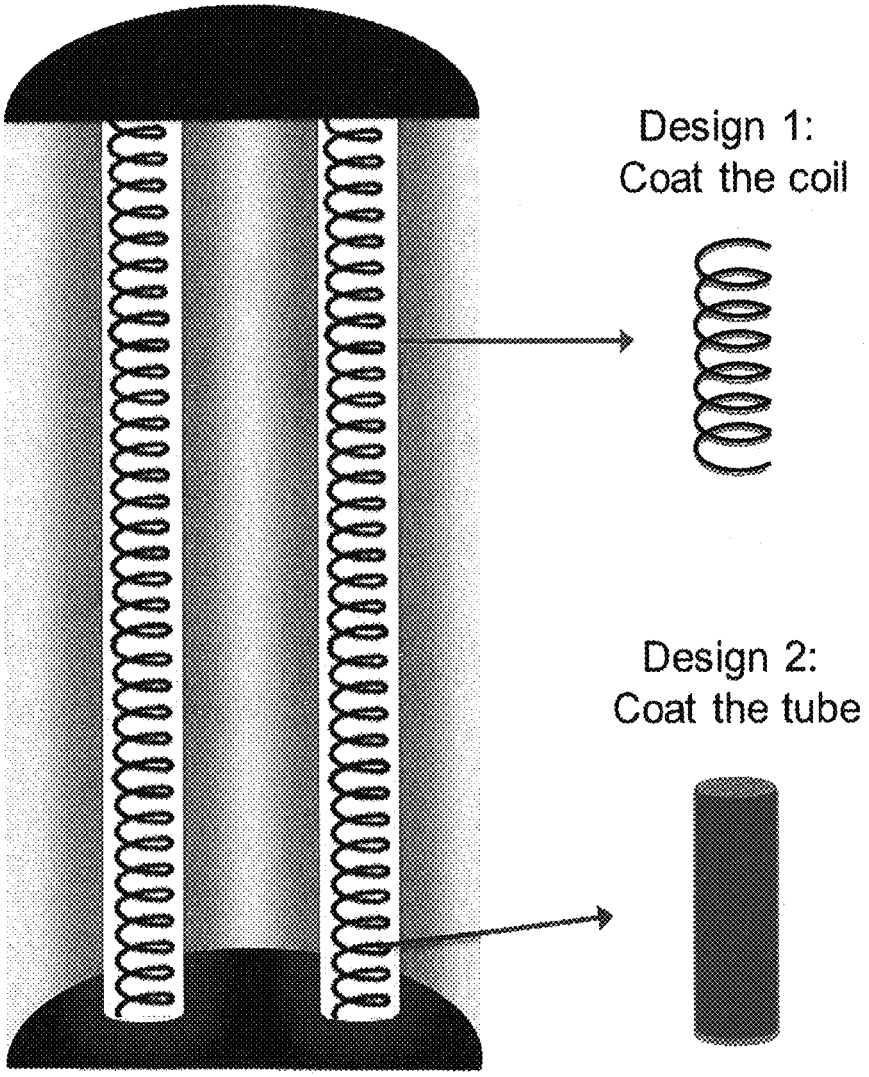
FIG. 5 illustrates an embodiment for the various described devices into a radiative heater design.

FIG. 5 shows an embodiment of the described photonic device. In order to meet the techno-economics challenge and keep the cost down, the ideal way to incorporate the selective emitter will be to keep the bill of material the same as a commercial radiative heater so that no significant manufacturing supply chain changes are expected. For design 1, which is a multilayer stack as an NIR emitter, the ideal way is to deposit it onto the filament coil of a commercial radiative heater. On the other hand, for design 2, which is a NIR filter, it can be deposited onto the quartz tube of a radiative heater. The film deposition can be performed with sputtering or CVD processes, Most cost-effective and highly controlled are hollow cathode sputtering and inverted cylinder magnetron sputtering.

The major technical challenge for this invention was to design a multilayer stack that was thermally, chemically and mechanically stable at high temperatures. At high temperatures (>673K), the vast majority of multilayer thin film devices suffer from oxidation, which destroy the desired optical properties and hurt the mechanical stability of the device. To overcome this problem, materials that do not suffer from oxidation and are mechanical robust at high temperatures are chosen for the design.

The photonic NIR heater device will resolve the following problems associated with current radiative heaters in building heating, process heating, and food processing.

Space heating for buildings: In year 2011 the United States consumed roughly 8 Quads of energy for heating of buildings. Greenhouse gas emissions from space heating accounts for about 8.7% of total emissions. Current approaches for space heating generally utilize a centralized heating system that raises the temperature inside an entire building or room. This is an extremely inefficient heating process because the majority of the heat is not utilized to locally warm people and is thus unnecessary. Localized heating systems that only heat up human bodies are a far more efficient form of space heating. Current space heating technology can only be improved through spatial control and is far more challenging as it requires a reconfiguration of the building interior or a complete replacement of the HVAC (heating ventilation air conditioning) units.

Therefore, the likelihood of current HVAC technologies reaching the resolution of individual occupants is very low. Another disadvantage associated with current space heating technologies is the high costs for retrofitting buildings with new technologies that result in long payback period (>5 years). Thus, radiative heating is a much more efficient form of space heating because it locally heats human bodies without wasting energy heating unutilized space within buildings/rooms and are easily modified to fit in the localized heating systems due to their high portability.

Radiative heaters such as infrared (IR) heaters are readily available in the market, however they suffer from two fundamental problems: (1) strong visible emission. The visible appearance of IR heaters greatly impacts the aesthetics of building interiors. As a result, these heaters have only been popular in outdoor and warehouse applications, where convective heating is impractical. (2) IR heater coils for space heating are typically made of Nichrome, which operate at ~800 degree celsius. The emission peak of these IR heaters is at ~3 um, which coincides with strong liquid water absorption. Due to water absorption overhead, infrared heaters tend to overheat the exposed areas of the human body (face and head) and underheat the clothed areas (feet and legs), creating discomfort due to the thermal asymmetry as well as skin dehydration.

Industrial process heating: Process heating, such as, curing, is very important in industrial coil coating processes. Traditional convective oven curing processes heat the entire sample and its substrate, followed by a cooling process where the substrate temperature decreases over a long period of time. The curing and cooling process can take hours, which is both energy and time consuming. Radiative curing has the ability to raise the temperature of the coating only, meanwhile maintain a low temperature throughout the sample's substrate. This is a more efficient process because the curing and cooling time is significantly reduced and less thermal energy is required. However, the generally used UV curing technology suffers from a high system cost and is subject to the photochemical reaction, and the IR radiation curing technology is not very effective due to its very small penetration depth into the material. In addition, recent research has also shown that if the radiative energy is absorbed in the top few microns of the coating, film formation may occur before full removal of solvents, which affects the film quality. This makes long wavelength IR radiation (>3 um) undesirable in coating curing processes.

Food processing: IR radiation is currently used in food processing and drying. However, long wavelength IR radiation (>3 um) does not penetrate through the first few microns of the food leading to slower and non-uniform dehydration at the surface.

Previous work has demonstrated structures with spectral selectivity over a wide range of wavelengths. There are other works which designed an optical structure that is transmissive in the visible range of light (0.4-0.7 μm) and highly reflective in the near infrared and infrared range. These inventions demonstrated photonic crystal designs that transmit desired visible light, which increase the efficiency of a visible light source. Other works have designed devices for selective infrared transmissivity over a range of wavelengths, while reflecting visible light.

However, no other work has aimed specifically at spectral selectivity in the near infrared range between 0.7 and 3 μm for the applications mentioned above. In addition, the prior work regarding spectrally selective infrared filters and emitters employed materials that lack thermal, chemical and mechanical stability at high operating temperatures. The devices disclosed herein are the first spectrally selective near infrared transmitters/emitters that operate at high temperatures associated with the previous mentioned industrial applications.

Industries that could Use this Invention

Space heating for buildings: The reported near infrared heater exhibits the following characteristics: (1) No glow i.e. no emission in the visible range (400 nm<wavelength<700 nm). (2) Low emission for wavelengths greater than 3 um, resulting in weaker absorption by water in the skin. (3) High radiative flux between 700 nm and 3 um. Most of the heat flux of the proposed heater lies in the desired NIR wavelength range, causing no glow and low water absorption from the skin, resulting in even temperature distribution between bare skin and clothing as discussed earlier.

Industrial process heating: Near infrared curing has recently become a popular form of industrial heat processing with the advantage of rapid curing and uniform heating over the coating film. Different from IR radiation, NIR radiation penetrates through the coating and raises the temperature of the entire layer volumetrically in a faster and more efficient manner. The high energy density of NIR radiation also allows for rapid curing in less than 10 seconds making it perfect for high speed production lines. In order to suppress the IR radiation, which affects the quality of the curing process, a high filament temperature is required for NIR curing process, which is typically around 3000 K. Due to the selectivity of our NIR emitter, the IR radiation is effectively suppressed even if the emitter is operating at a temperature more than 500K lower. This extends the filament life and increases the system stability, which reduces the maintenance cost.

Food processing: NIR radiation has a greater penetration depth in organic materials than IR radiation, leading to greater efficiency and reduced heating times in thicker organic materials. Experiments have shown that NIR radiation dries apple slices faster and more efficiently than IR radiation, due to its larger penetration depth and a uniform volumetric heating effect. In order to generate NIR radiation and process/dry the food, the emitter needs to operate at a high temperature, which might damage the food and also decrease the lifetime of the NIR heater. However, the proposed NIR heater can generate a good fraction of NIR radiation even if it is at a relatively low temperature due to its spectral selectivity, which allows for NIR food drying at a low temperature.

What is claimed is:

1. A multilayer photonic stack comprising:

a lower portion of layers comprising a first layer of A and a first layer of B, the first layer of A comprising at least one of Al, Au, W, Ag, Ni, Ti, Pt, and Cr, and the first layer of B comprising at least one of $Al_2O_3$, AlN, MgO, $SiO_2$, $TiO_2$, $Si_3N_4$, $MgF_2$, $Ta_2O_5$, SiC, Si, Ge, and indium tin oxide (ITO); and an upper portion of layers disposed on the lower portion of layers, the upper portion of layers comprising a plurality of sets of a layer of C and a layer of D disposed on the layer of C, the layer of C and the layer of D each comprising at least one of $Al_2O_3$, AlN, MgO, $SiO_2$, $TiO_2$, $Si_3N_4$, $MgF_2$, $Ta_2O_5$, SiC, Si, Ge, and indium tin oxide (ITO), and the layer of C and the layer of D being different compositions;

the multilayer photonic stack having an emissivity in the near infrared (NIR) range with the emissivity being at a maximum at a wavelength between 0.7 microns and 3 microns, and the multilayer photonic stack being disposed on a filament coil of a radiative heater.

2. The multilayer photonic stack of claim 1, wherein the lower portion of layers comprises a second layer of A to form a structure comprising the first layer of B disposed between the first layer of A and the second layer of A.

3. The multilayer photonic stack of claim 1, wherein a thickness of the first layer of A is 5 nanometers to 1 micron, and wherein a thickness of the first layer of B is 5 nanometers to 1 micron.

4. The multilayer photonic stack of claim 1, wherein a thickness of the layer of C is 5 nanometers to 1 micron, and wherein a thickness of the layer of D is 5 nanometers to 1 micron.

5. The multilayer photonic stack of claim 2, wherein a thickness of the second layer of A is 5 nanometers to 1 micron.

* * * * *